US007242893B2

(12) United States Patent
Murakami et al.

(10) Patent No.: US 7,242,893 B2
(45) Date of Patent: Jul. 10, 2007

(54) DEVELOPER SUPPLY CONTAINER

(75) Inventors: Katsuya Murakami, Toride (JP); Yutaka Ban, Tokyo (JP); Nobuo Nakajima, Kashiwa (JP)

(73) Assignee: Canon Kabiushiki Kaisha, Tokyo (JP)

( * ) Notice: Subject to any disclaimer, the term of this patent is extended or adjusted under 35 U.S.C. 154(b) by 127 days.

(21) Appl. No.: 11/004,975

(22) Filed: Dec. 7, 2004

(65) Prior Publication Data

US 2005/0135842 A1 Jun. 23, 2005

(30) Foreign Application Priority Data

Dec. 10, 2003 (JP) ..... 2003-411339
Nov. 26, 2004 (JP) ..... 2004-341604

(51) Int. Cl.
*G03G 15/08* (2006.01)

(52) U.S. Cl. ..... 399/262

(58) Field of Classification Search ..... 399/262
See application file for complete search history.

(56) References Cited

U.S. PATENT DOCUMENTS

| | | | | |
|---|---|---|---|---|
| 5,572,301 | A | 11/1996 | Shiratori | 399/234 |
| 5,907,756 | A | 5/1999 | Shirota et al. | 399/262 |
| 6,049,685 | A | 4/2000 | Murakami et al. | 399/263 |
| 6,128,453 | A | 10/2000 | Ban et al. | 399/106 |
| 6,185,401 | B1 | 2/2001 | Kanamori et al. | 399/262 |
| 6,256,467 | B1 * | 7/2001 | Yokomori et al. | 399/119 |
| 6,278,853 | B1 | 8/2001 | Ban et al. | 399/109 |
| 6,785,497 | B1 * | 8/2004 | Hasebe | 399/260 |
| RE38,737 | E | 5/2005 | Ban et al. | 399/106 |
| 2004/0009016 | A1 * | 1/2004 | Kato et al. | 399/260 |
| 2004/0047657 | A1 | 3/2004 | Nagashima et al. | 399/262 |
| 2004/0123919 | A1 * | 7/2004 | Takagi | 141/352 |
| 2005/0135842 | A1 | 6/2005 | Murakami et al. | 399/262 |

FOREIGN PATENT DOCUMENTS

| | | |
|---|---|---|
| EP | 1 376 258 A2 | 1/2004 |
| JP | 7-199620 | 8/1995 |
| JP | 10-048936 A2 | 2/1998 |
| JP | 11-194600 | 7/1999 |
| JP | 3095050 | 8/2000 |
| JP | 2003-76123 A | 3/2003 |
| JP | 2003-162137 | 6/2003 |
| JP | 2004-170747 A | 6/2004 |

* cited by examiner

*Primary Examiner*—Vincent Q. Nguyen
(74) *Attorney, Agent, or Firm*—Fitzpatrick, Cella, Harper & Scinto

(57) ABSTRACT

A developer supply container detachably mountable to developer receiving apparatus, includes container body accommodating a developer, the container body being provided with a developer supply port for supplying the developer through a developer receiving port provided in the developer receiving apparatus; a driving connecting member for operatively connecting to a driving member provided in the developer receiving apparatus, the driving connecting member being movable relative to the container body; and an interrelating mechanism for interrelating movement of the driving connecting member with movement of the developer supply port to face the developer receiving port.

20 Claims, 9 Drawing Sheets

DEVELOPER SUPPLY CONTAINER

FIELD OF THE INVENTION AND RELATED ART

The present invention relates to a developer supply container for supplying an image forming apparatus as a copying machine, a facsimile machine, a printer, etc., which employs an electrophotographic or electrostatic recording method, with developer.

As the developer for an image forming apparatus, such as an electrophotographic copying machine, a printer, etc., particulate toner has long been used. Thus, it has been a common practice to supply the image forming apparatus with developer with the use of a developer supply container, as the developer in the main assembly of an image forming apparatus is depleted by consumption. However, this method has been problematic in that during the operation for supplying an image forming apparatus with developer, the developer scatters, contaminating an operator and/or the adjacencies of the apparatus, because developer is in the form of extremely minute particulates. Thus, various methods for supplying an image forming apparatus with developer have been developed, and some of them have been put to practical use. According to one of such methods, a developer supply container is placed in the main assembly of an image forming apparatus, and developer is discharged from the developer supply container little by little through the small opening with which the developer supply container is provided.

Regarding developer supply containers, such as the above-described one in accordance with the prior art, a substantial number of proposals have been made to place in a developer supply container, a member for conveying developer while stirring it. For example, according to Japanese Laid-open Patent Application 7-199620 or Japanese Patent No. 3095050 (which corresponds to U.S. Pat. No. 5,572,301), the cylindrical wall of the cylindrical container is provided with a developer outlet, in the form of a slit, which extends in the axial direction of the cylindrical container. When the cylindrical developer container is mounted into the main assembly of an image forming apparatus, it is to be positioned so that the developer outlet faces upward. Then, after the container is completely mounted, the container is to be rotated so that the developer outlet of the developer container aligns with the developer inlet on the image forming apparatus side.

On the other hand, there have also been proposed a substantial number of developer supplying methods different from the above-described ones. According to them, after the mounting of the developer supply container into the main assembly of an image forming apparatus, the developer outlet of the developer supply container is opened or closed while the container proper of the developer supply container is kept immobilized. For example, according to the developer supplying method disclosed in Japanese Laid-open Patent Application 11-194600 (which corresponds to U.S. Pat. No. 6,185,401), the cylindrical developer supply container is mounted into the main assembly of an image forming apparatus, and then, the handle of the container is rotated to open the shutter of the container.

Each of the abovementioned developer supply containers is structured so that roughly at the end of the process of mounting the developer supply container into the main assembly of an image forming apparatus, the coupler on the developer-supply-container side automatically couples with the driving force transmission mechanism on the main assembly side of the image forming apparatus. Thus, even if an operator forgets to unseal the developer supply container, the coupler on the developer supply container side is enabled to receive the rotational driving force from the driving force transmitting mechanism on the main assembly side. Therefore, it is possible that the developer in the developer supply container will be damaged. Thus, in order to deal with this kind of problem, the main assembly of an image forming apparatus is provided with an error prevention mechanism which detects whether or not a developer supply container has been unsealed, and prevents a developer supply container from being driven when the container has not been unsealed. However, should this mechanism breaks down for some reason, the occurrence of the above-described problem cannot be avoided. Obviously, it is possible to take various measures to prevent the error prevention mechanism from breaking down or malfunctioning. However, such measures are problematic in that they tend to make an image forming apparatus complicated, and also, add to the apparatus cost.

Japanese Laid-open Patent Application 2003-162137 proposes a structural arrangement for dealing with the above-described problems. According to this application, the coupler on the developer supply container side does not automatically couple with the driving force transmission mechanism on the main assembly side of an image forming apparatus toward the end of the process of mounting the developer supply container into the main assembly. More specifically, the developer supply container is provided with a lever which is to be rotated to cause the coupler on the container side to project in the direction parallel to the thrust direction thereof, and the lever is to be rotated after the mounting of the container into the main assembly to make the coupler on the container side couple with the driving force transmission mechanism on the main assembly side.

However, it is possible that even the developer supply container disclosed in Japanese Laid-open Patent Application 2000-162137 will suffer from the above-described problem, because of the following reason. That is, in the case of the developer supply container disclosed in this patent application, the operation for unsealing the developer supply container is independent from the operation for causing the coupler of the container to project to make the coupler to couple with the driving mechanism on the main assembly side. Therefore, there is the possibility that even though the developer supply container has not been unsealed, the operation for coupling the coupler on the container side with the driving mechanism on the main assembly side will be carried out, causing thereby the above-described problem.

Further, in the case of the developer supply container disclosed in Japanese Laid-open Patent Application 2003-162137, the operation for unsealing the developer supply container, and the operation for connecting the developer supply container with the driving mechanism, are independent from each other, turning the operation for replenishing an image forming apparatus with developer into an annoyance. In other words, the developer supply container disclosed in this patent application also falls short in operability.

SUMMARY OF THE INVENTION

The primary object of the present invention is to provide a developer supply container superior, in operability, to developer supply containers in accordance with the prior art.

Another object of the present invention is to provide a developer supply container which does not damage the developer therein.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Next, the developer supply container in the first embodiment of the present invention will be concretely described with reference to the appended drawings.

Embodiment 1

{Image Forming Apparatus}

First, referring to FIG. 1, an electrophotographic copying machine, as a typical electrophotographic image forming apparatus, in which a developer supply container in accordance with the present invention is mounted, will be described regarding its structure.

Figure 1:
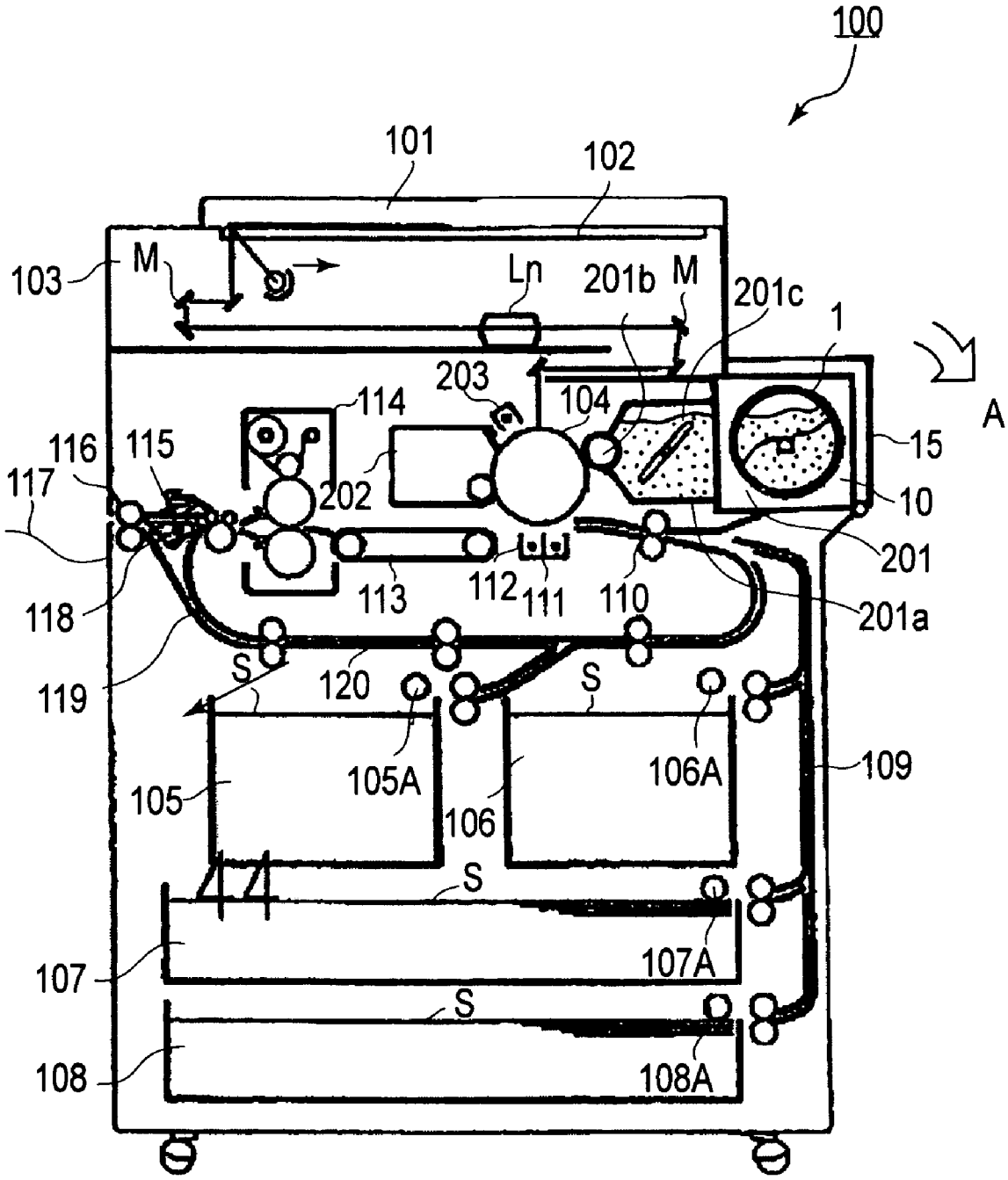
FIG. 1 is a sectional view of the image forming apparatus in one of the preferred embodiments of the present invention, showing the general structure thereof.

In FIG. 1, designated by a reference number 100 is the main assembly of the electrophotographic copying machine (which hereinafter will be referred to as apparatus main assembly). Designated by a reference number 101 is an original, which is placed on a glass platen 102. An optical image in accordance with the image formation data is formed on the electrophotographic photosensitive drum 104 by the combination of a plurality of mirrors M and a plurality of lenses Ln. Designated by reference numbers 105-108 are cassettes, from among which the cassette containing recording media (which hereinafter may be referred to simply as papers) P, which agree in size with the information inputted by an operator through the control panel, or are the most suitable to the size of the original 101, is selected, based on the information regarding the sizes of the papers in the cassettes 105-108. The recording medium does not need to be limited to paper. For example, an OHP sheet or the like may be used as necessary.

The papers P are conveyed one by one by separating and conveying apparatuses 105A-108A, to a pair of registration rollers 110 by way of a paper conveyance path 109. Then, each paper P is conveyed further by the pair of registration rollers 110 in synchronism with the rotation of the photosensitive drum 104 and the scanning timing of the optical portion 103. Designated by reference numbers 111 and 112 are a transfer discharger for transferring the developer image (which hereinafter will be referred to as toner image) formed on the photosensitive drum 104, onto the paper P, and a separation discharger for separating the paper P from the photosensitive drum 104 after the transfer of the toner image onto the paper P, respectively.

Thereafter, the paper P is further conveyed by a paper conveying portion 113 to the fixation station 114, in which the toner image on the paper P is fixed by heat and pressure. Then, when the copying machine is in the single-sided print mode, the paper P is moved through the reversing station 115, without being placed upside down, and is discharged into the delivery tray 117 by a pair of discharge rollers 116. When the machine is in the two-sided print mode, the flapper 118 of the reversing station 115 is controlled so that the paper P is conveyed to the pair of registration rollers 110 by way of re-feeding conveyance paths 119 and 120. Then, the paper P is made to move through the same paths as those through which the paper P is moved when the machine is in the single-sided print mode, and is discharged into the delivery tray 117.

When the machine is in the multilayer print mode, the paper P is sent through the reversing station 115 so that it is stopped after it is partially extended outward from the main assembly by the pair of discharge rollers 116. More specifically, it is stopped immediately after the trailing edge of the paper P is moved past the flapper 1118, while the paper P remains pinched by the pair of discharge roller 116. Then, the flapper 118 is switched in position, and the pair of discharge rollers 116 are rotated in reverse so that the paper P is conveyed back into the main assembly. Thereafter, the paper P is conveyed to the registration rollers 110 through paper re-conveyance paths 119 and 120. Then, it is moved through the same paths as those through which it is moved when the machine is in the single-side print mode, and discharged into the delivery tray 117.

In the main assembly 100 of the copying machine structured as described above, the developing apparatus 201, the cleaning station 202, the primary charger 203, etc., are disposed in the adjacencies of the peripheral surface of the drum 104. The cleaning station 202 is where the toner remaining on the peripheral surface of the photosensitive drum 104 is removed. The primary charger 203 is for charging the photosensitive drum 104.

{Developing Apparatus}

The developing apparatus 201 is the apparatus which develops, with the use of toner, the electrostatic latent image formed on the peripheral surface of the drum 104 by the optical station 103, based on the image formation data extracted from the original 101. The toner supply container 1 for supplying this developing apparatus 201 with toner is to be removably mounted in the main assembly 100 of the copying machine by a user.

The developing apparatus 201 comprises a toner receiving apparatus 10 as a developer receiving apparatus in which the toner supply container 1 is removably mounted to supply the main assembly of the apparatus with toner, and a developing device 201*a* (single-component developing device). Further, the developing device 201*a* comprises a development roller 201*b* and a developer conveying member 201*c*.

Figure 2:
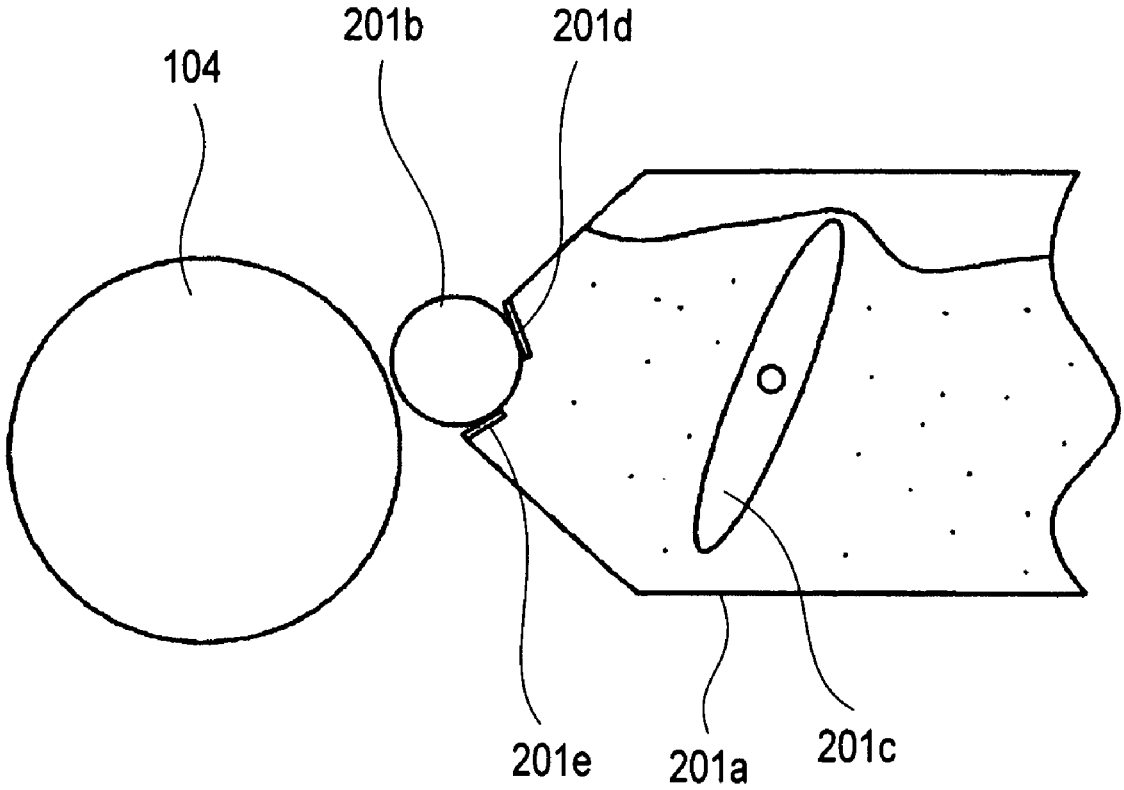
FIG. 2 is a schematic sectional view of the developing apparatus in the first embodiment of the present invention.

After being supplied from the toner supply container 1 into the toner receiving apparatus 10, the toner is sent by the conveying member 201*c* to the development roller 201*b*, by which the toner is supplied to the photosensitive drum 104. Further, referring to FIG. 2, the developing apparatus 201 is provided with a development blade 201*d* as a regulating member for regulating the amount of toner allowed to remain on the development sleeve 201*b*, and a toner leak prevention sheet 201*e*, which is a member for preventing toner from being blown out of the developing apparatus 201, through the gap between the housing of the developing device 201*a* and development sleeve 201*b*, and which is placed in contact with the peripheral surface of the development sleeve 201*b*.

Incidentally, the developer with which the image forming apparatus in accordance with the present invention is to be supplied may be the toner for a two-component developing device, or a mixture of the toner for a two-component developing device and carrier, in addition to the abovementioned toner for a single-component developing device.

The image forming apparatus is provided with a cover 15 for replacing a toner supply container. The cover 15 constitutes a part of the external shell of the apparatus. It is opened in the direction indicated by an arrow mark A in FIG. 1, when a user mounts the toner supply container 1 into the main assembly 100 of the image forming apparatus or removes it therefrom.

{Toner Supply Container}

Figure 4:
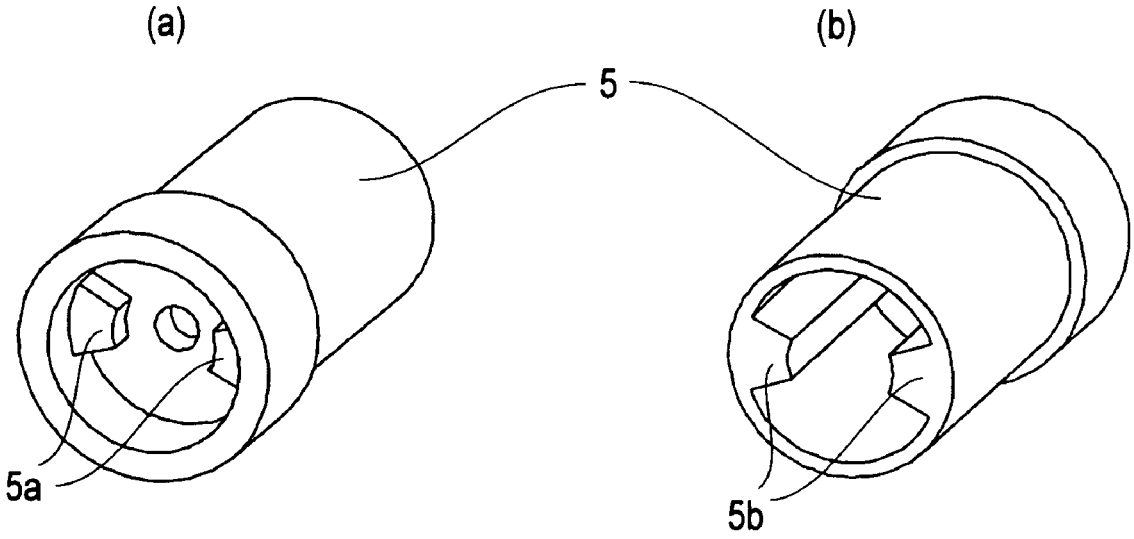
FIGS. 4(*a*) and 4(*b*) are perspective views of the coupling on the developer supply container side, in the first embodiment of the present invention.
Figure 5:
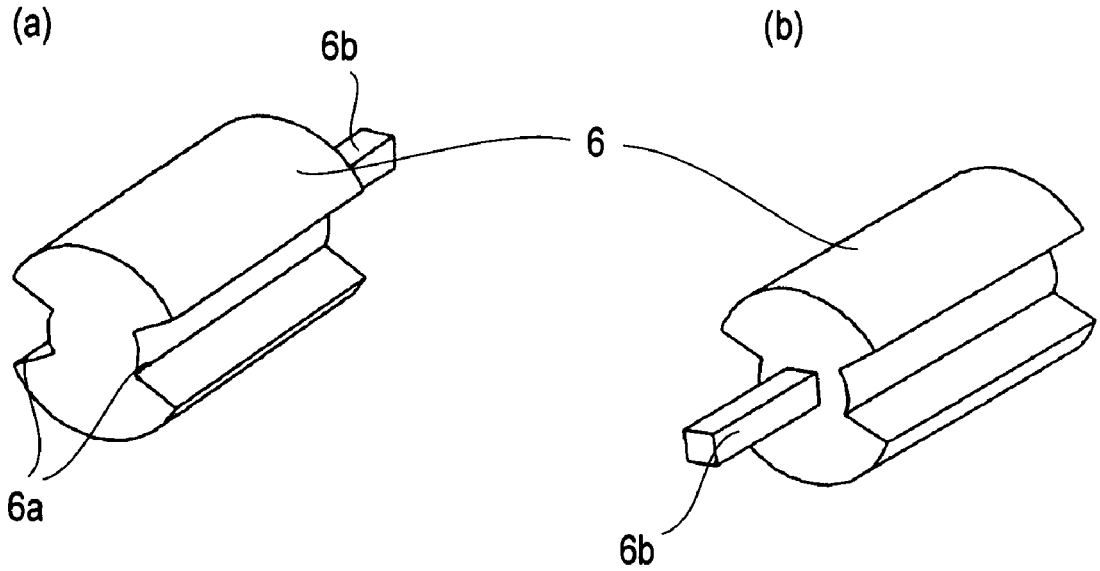
FIGS. 5(*a*) and 5(*b*) are perspective views of the intermediary member of the driving force receiving portion on the developer supply container side, in the first embodiment of the present invention.

Next, referring to FIGS. 3-5, the toner supply container 1, as a developer supply container, in this embodiment of the present invention will be described regarding its structure.

The toner supply container 1 has a roughly cylindrical container proper 1*a*, in which toner is stored. The cylindrical wall portion of the container proper 1*a* is provided with a toner outlet (toner discharge hole) 1*b*, in the form of a slit, which extends in the lengthwise direction of the container proper 1*a*.

The container proper 1*a* is also provided with a toner filling hole 1*c*, which is a part of one of the end walls of the container proper 1*a* in terms of the lengthwise direction of the container proper 1*a*. The toner filling hole 1*c* is sealed with an unshown sealing member or the like after the container proper 1*a* is filled with toner.

The toner supply container 1 is provided with a handle 2, which is attached to the cylindrical wall portion of the container proper 1*a*. This handle 2 is to be grasped when a user mounts or dismounts the toner supply container 1, and also, when a user rotates the toner supply container 1.

Further, the toner supply container 1 is provided with a stirring member 4, which is disposed within the container proper 1*a*. As the stirring member 4 receives the rotational driving force through the driving force transmission coupling (which will be described later), it rotates relative to the container proper 1*a*, conveying thereby the toner in the container proper 1*a*, while stirring it, and discharges the toner through the toner discharge hole 1*b*.

Figure 3:
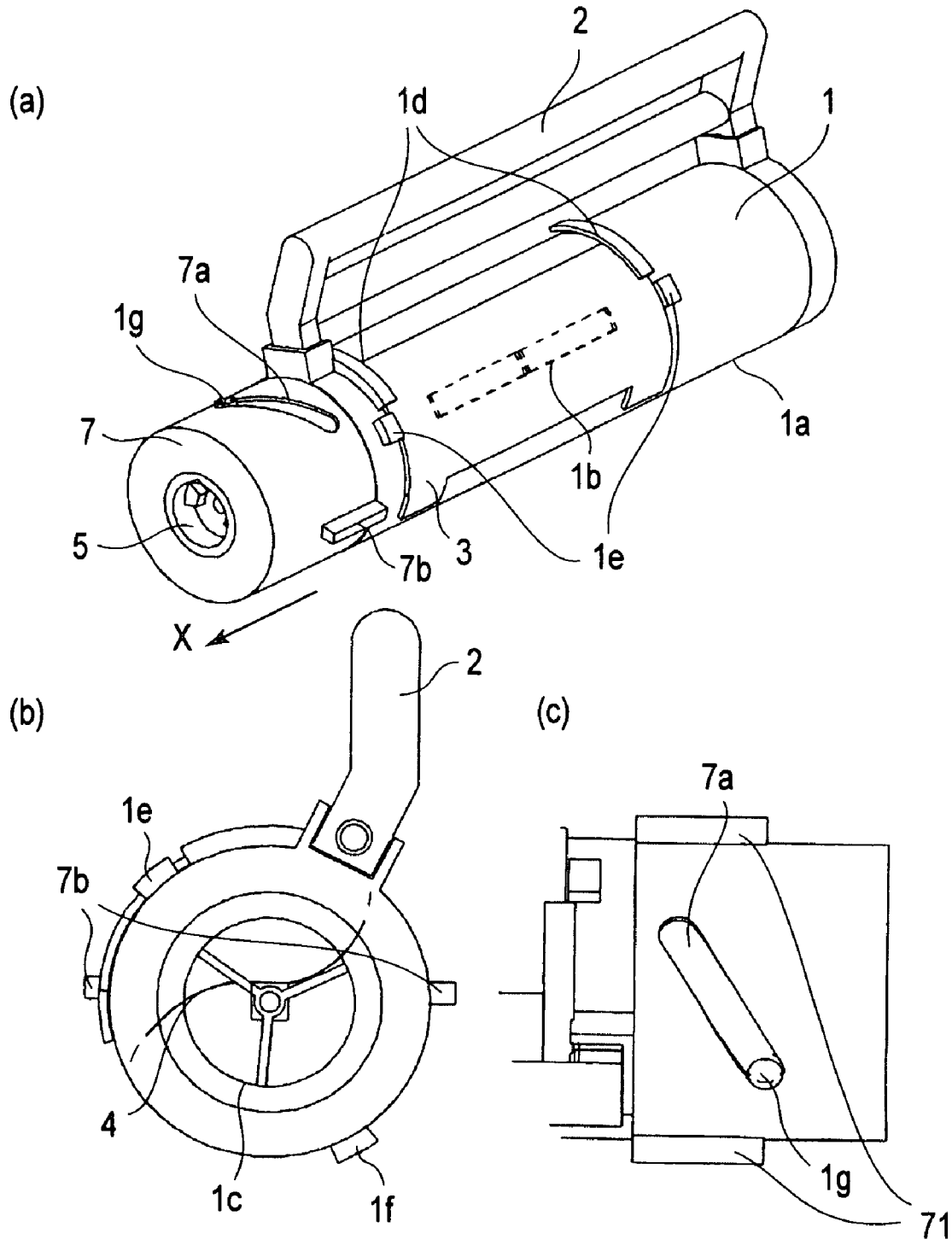
FIGS. 3(*a*), 3(*b*), and 3(*c*) are a perspective view, a side view, and an enlarged top view, respectively, of the toner supply container in the first embodiment of the present invention.

Referring to FIG. 3(*a*), the toner discharge hole 1*b* is sealed by a container shutter 3, the curvature of which matches that of the cylindrical wall portion of the container proper 1*a* of the toner supply container 1. The container shutter 3 is engaged with a pair of guiding portions 1*d* located at the edges of the toner discharge hole 1*b*, one for one, in terms of the lengthwise direction of the toner supply container 1. The container shutter 3 is slidable in the curvature direction of the container proper 1*a* to open or close the toner discharge hole 1*b*.

The toner supply container 1 is also provided with a pair of projections 1*e*, and a pair of projections 1*f*, which are on the peripheral surface of the container proper 1*a*. The projections 1*e* are for pushing down the developing device shutter 11 (which will be described later) to unseal the toner reception hole 10*b* (FIG. 7) after the toner supply container 1 is set in the toner receiving apparatus 10, whereas the projections 1*f* are for pulling up the developing device shutter 11 in order to seal the toner reception hole 10*b* after the toner supplying operation is completed.

The projections 1*e* for unsealing the toner reception hole 10*b*, and projections 1*f* for sealing the toner reception hole 10*b*, are positioned so that after the mounting of the toner supply container 1 into the toner receiving apparatus 10 (FIG. 7), the projections 1*e* will be on the upstream and downstream sides, respectively, of the developing device shutter 11, in terms of the direction in which the toner supply container 1 is rotated to unseal the toner reception hole 10*b*.

Incidentally, the projections 1*e* and 1*f*, as shutter engaging portions, do not need to be in the above-described form, as long as they are capable of opening or closing the developing device shutter 11 as the developer supply container 1 is rotated; they may be different in structure.

Further, the toner supply container 1 is provided with a connective means for coupling the toner supply container with the driving force transmitting mechanism of the toner receiving apparatus, as the toner supply container 1 is rotated by an operator by the handle 2 after the mounting of the toner supply container 1 into the toner receiving apparatus, and through which the toner supply container 1 receives the driving force from the main assembly 100. This connective means is structured so that the driving force received by the connective means from the driving force transmitting mechanism is transmitted to the stirring member 4.

To describe the structure of the connective means, the toner supply container 1 is provided with a coupling 5 as a connective member, which is attached to one of the end walls of the container proper 1*a* in terms of the lengthwise direction of the container proper 1*a*. Referring to FIG. 4, this coupling 5 comprises a pair of claw-like portions 5*a* by which the coupler 5 receives the rotational driving force from the driving force transmitting mechanism of the toner receiving apparatus, and a pair of claw-like portions 5*b* by which the coupler 5 transmits the received rotational driving force to an intermediary member 6 (FIG. 5).

Referring to FIG. 3, the coupling 5 is supported by a coupling supporting portion 7, which allows the coupling 5 to freely rotate while preventing the coupling 5 from moving in the direction parallel to the axial line of the coupling 5.

Further, the toner supply container 1 is provided with a mechanism (which will be described later) for moving the coupling 5. The coupling moving mechanism is fitted around one end of the container proper 1*a*. The coupling moving mechanism comprises a camming hole 7*a* (camming mechanism), which is a part of the coupling, supporting portion 7 and extends at a predetermined angle relative to the lengthwise direction of the container proper 1*a*, a pair of rotation control projections 7*b* attached, roughly symmetrically with respect to the axial line of the coupling supporting portion 7, to the peripheral surface of the connective mechanism, and a cam follower 1*g* (camming mechanism) which projects from the peripheral surface of the container proper 1*a* and is fitted in the camming hole 7*a*.

As a user rotates the container proper 1*a* of the toner supply container 1 structured as described above, by grasping the handle 2, the coupling supporting portion 7 is slid with the coupling 5, away from the container proper 1*a*, by the above-described camming mechanism, in the direction (X direction in FIG. 3) parallel to the rotational axis of the container proper 1*a*. The function of the rotation regulating projections 7*b* will be described later.

Further, within the container proper 1*a*, the intermediary member 6 for transmitting the driving force to the stirring member 4 is placed. Referring to FIG. 5, the intermediary member 6 is provided with a groove 6*a*, the wall of which catches the rotational driving force from the coupling 5, and a shaft portion 6*b* from which the received rotational driving force is transmitted to the stirring member 4. The intermediary member 6 is supported by the shaft portion 6*b* so that it does not move in the lengthwise direction of the container proper 1*a*.

Figure 6:
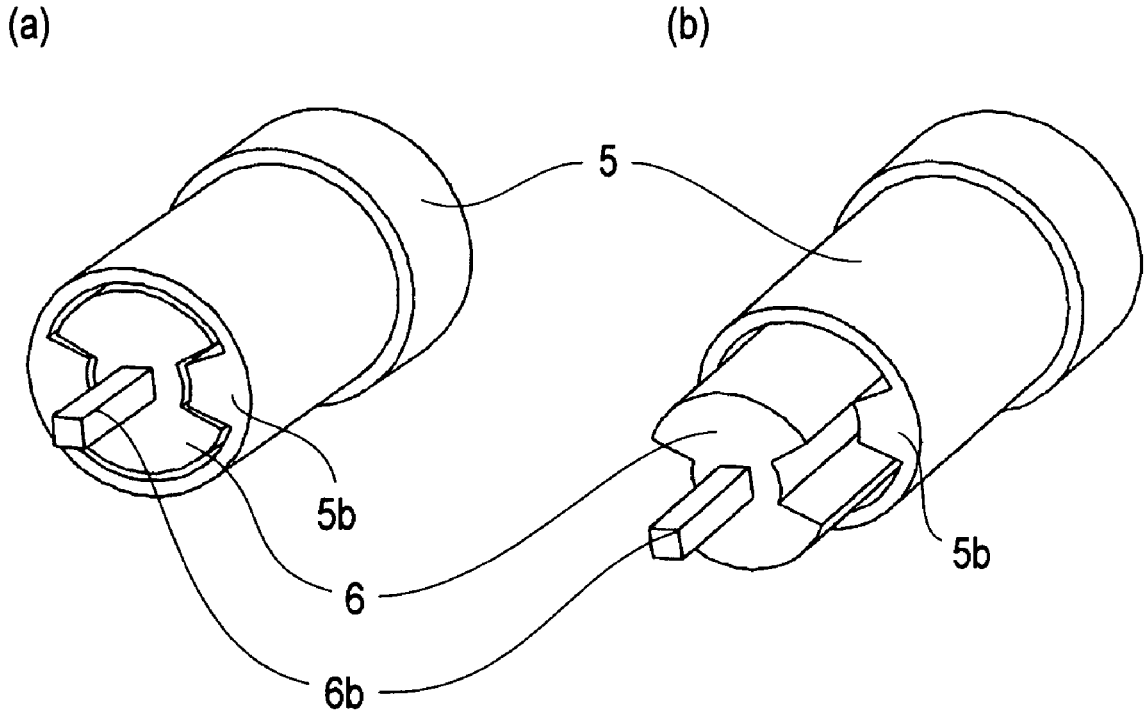
FIGS. 6(*a*) and 6(*b*) are perspective views of the driving force receiving coupling and intermediary member of the developer supply container, showing the states of them before and after, respectively, the coupling supporting portion is moved to engage the coupler on the developer supply container side with the driving force transmitting mechanism on the main assembly side.

The coupling 5 and intermediary member 6 are engaged with each other, in the toner supply container 1, as shown in FIG. 6(*a*).

The coupling 5 and coupling supporting portion 7 are structured so that the former is allowed to move back and forth with the latter, in the direction parallel to the axial line of the container proper 1*a*, and also, that even after the coupling 5 is moved to the location (FIG. 6(*b*)) at which it engages with the driving mechanism of the toner receiving apparatus, in other words, even after the intermediary member 6 partially comes out of the coupling 5, the driving force can be transmitted to the intermediary member 6.

Figure 7:
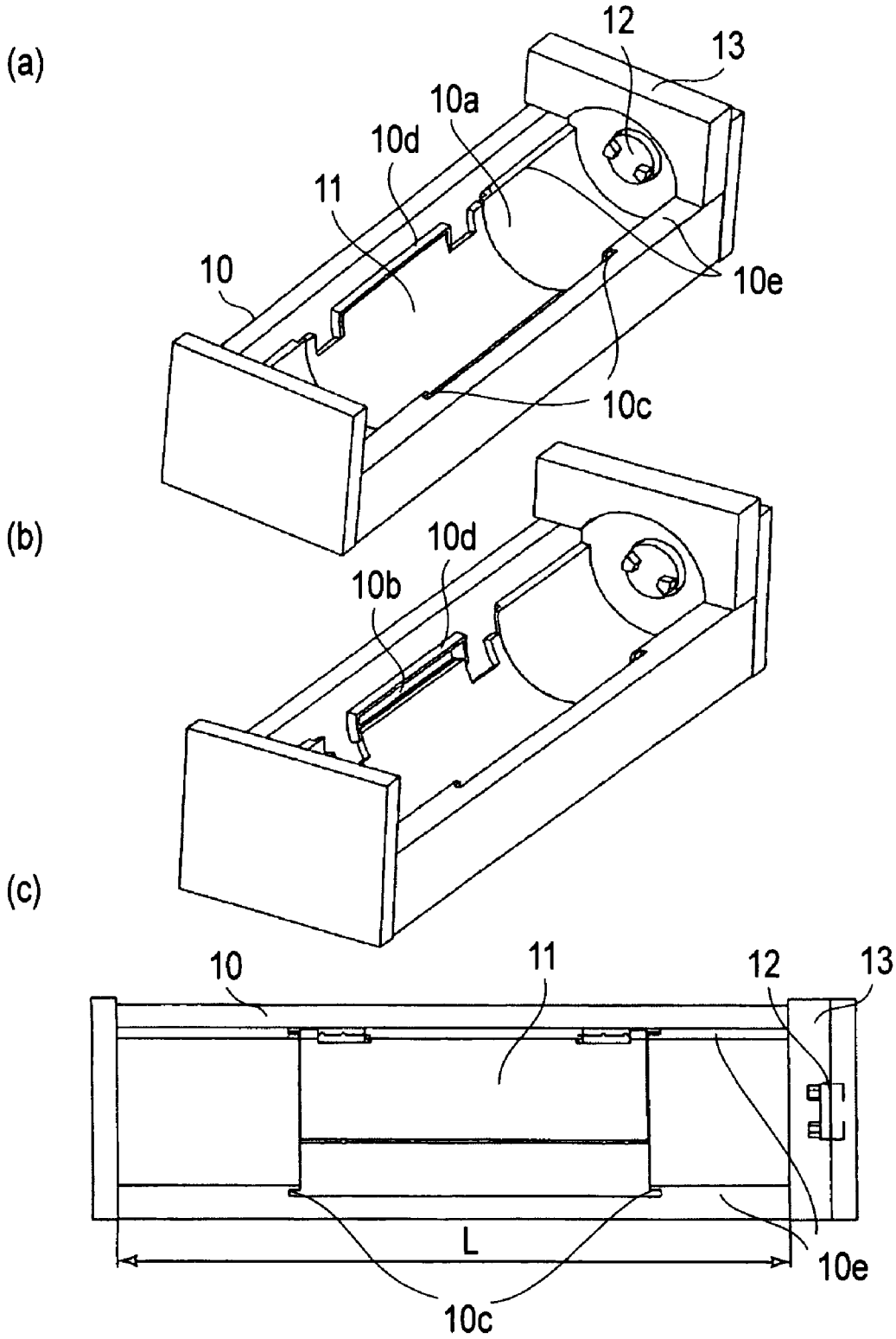
FIGS. 7(*a*) and 7(*b*) are perspective views of the toner receiving apparatus in the first embodiment of the present invention, showing the state of the apparatus before and after, respectively, the toner receiving hole is unsealed, and FIG. 7(*c*) is a top view of the toner receiving apparatus.

Next, referring to FIGS. 7(*a*)-(*c*), the structure of the toner receiving apparatus 10 in this embodiment will be described.

The toner receiving apparatus 10 is provided with a toner supply container bay 10*a* in which the toner supply container 1 is removably set, and a toner reception hole 10*b* through which the toner discharged from the toner supply container 1 is received into the development chamber (unshown). It is also provided with control surfaces 10*e*, with which the above-described rotation control projections 7*b* of the coupling supporting portion 7 come into contact.

Further, it is provided with a semicylindrical developing device shutter 11, the curvature of which matches the curvatures of the cylindrical wall of the container proper 1*a* of the toner supply container 1, and the semicylindrical wall of the toner supply container bay 10*a*. The developing device shutter 11 is engaged with a pair of guiding portions 10*c* attached to the bottom surface of the semicylindrical wall of the toner supply container bay 10*a* so that it is allowed to slide along the bottom surface of the semicylindrical wall of the toner supply container bay 10*a* to open or close the toner reception hole 10*b*.

When the toner supply container 1 is not in the toner supply container bay 10*a*, the developing device shutter 11 remains in the position in which one of its edges is in contact with the stopper 10*d* of the toner receiving apparatus 10, keeping the toner reception hole 10*b* sealed to prevent the contamination which occurs as toner flows back from the development chamber into the toner supply container bay 10*a*.

The toner receiving apparatus 10 is provided with a driving portion 12 as a driving force transmitting member, and a driving member cover 13 for protecting the driving force transmitting member 12, or the like purpose. The driving force transmitting member 12 and cover 13 are located at one end of the toner supply container bay 10*a* in terms of the lengthwise direction of the toner supply container bay 10*a*. The driving force transmitting member 12 is rotationally driven by the force from the main assembly of the image forming apparatus. The driving member cover 13 is configured and positioned so that the driving force transmitting member 12 appears completely covered as seen from the direction from which the toner supply container 1 is mounted (FIG. 7(*c*)).

The driving force transmitting member 12 is structured so that it is driven by the mechanical power source, which drives the toner moving member 201*c* and development sleeve 201*b* of the developing device, as well as the photosensitive drum 104; in other words, it is connected to the driving force transmission mechanism. Therefore, when the driving force transmitting member 12 is rotating, the development sleeve 210*b* is also rotating. Therefore, as the driving force transmitting member 12 is rotated in the direction opposite to the normal direction, the development sleeve 210*b* also is rotated in the direction opposite to the normal direction. Therefore, there is the possibility that this setup will create such a problem that the tips of the above-described development blade 201*d* and/or toner leak prevention sheet 201*e* are tucked into their under sides.

According to the present invention, however, the problem that the development sleeve 210*b* is rotated in reverse by the reverse rotation of the driving force transmitting member 12 can be prevented, as will be described later, even if the toner receiving apparatus is structured as described above.

A distance L between the driving member cover 13 and the end of the toner supply container bay 10*a* opposite from the location of the driving member cover 13 is set to be no less than the length of the toner supply container 1, making it easy for the toner supply container 1 to be removably mounted into the toner supply container bay 10*a*. In other words, the toner receiving apparatus 10 is structured so that the toner supply container 1 can be mounted into, or dismounted from, the toner receiving apparatus 10 in a direction perpendicular to the lengthwise direction of the toner supply container 1 (the direction in which coupling 5 is movable, that is, the direction parallel to rotational axis of container proper 1*a*).

Next, referring to FIGS. 8(*a*)-(*c*), and FIGS. 9(*a*)-(*c*), the operation for supplying the main assembly of the image forming apparatus with toner with the use of the toner supply container 1 and the toner receiving apparatus 10 in this embodiment will be described.

Figure 8:
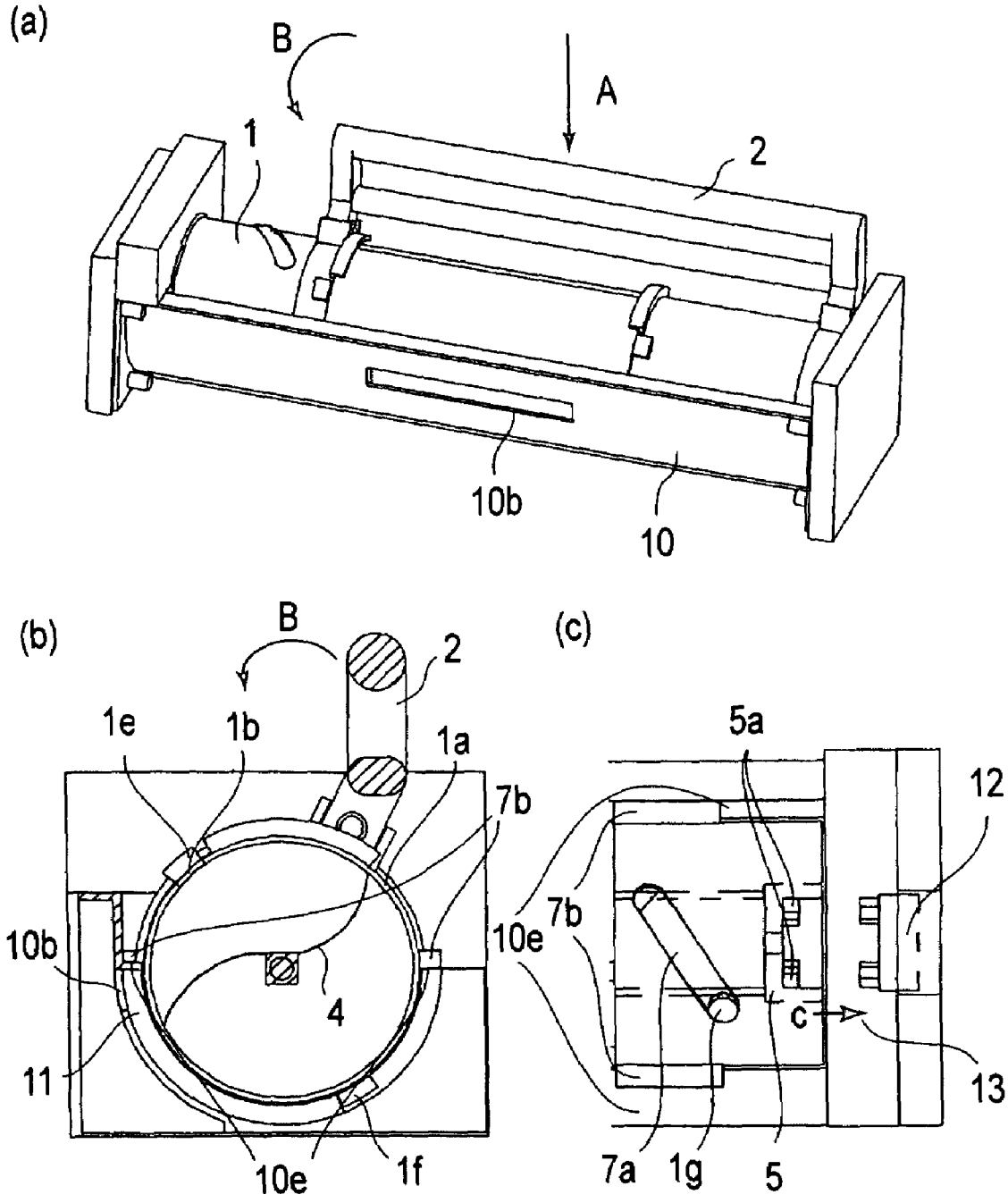
FIGS. 8(*a*), 8(*b*), and 8(*c*) are a perspective view, a sectional view (perpendicular to the axial line of the developer supply container), and an enlarged top view, respectively, of the toner supply container and toner receiving apparatus, immediately after the mounting of the former into the latter.

First, the toner supply container 1 is to be mounted into the toner receiving apparatus 10 in the direction indicated by an arrow mark A (FIG. 8(*a*)). As the toner supply container 10 is mounted, the two rotation control projections 7*b* of the coupling supporting portion 7 come into contact with the toner supply container rotation surfaces 10*e*, one for one, preventing thereby the coupling supporting portion 7 from rotating (FIGS. 8(*b*) and 8(*c*)).

Next, referring to FIGS. 8(*a*) and 8(*b*), a user is to rotate the toner supply container 1 in the direction indicated by an arrow mark B (frontward in FIG. 8) by the handle 2. As the toner supply container 1 is rotated, the developing device shutter 11 is pushed down by the pair of projections 1*e* of the toner supply container 1 by the rotation of the container proper 1*a*. As a result, the toner reception hole 10*b* is unsealed.

Also as the toner supply container 1 is rotated, the toner supply container shutter 3 is moved relative to the container proper 1*a*, because the container shutter 3 is prevented by the stopper portion of the toner receiving apparatus 10 from rotating with the container proper 1*a*. As a result, the toner discharge hole 1*b* is unsealed. Consequently, the toner discharge hole 1*b* becomes connected to the toner reception hole 10*b* (FIG. 8(*b*), FIG. 9(*b*)). The toner supply container 1 and the toner receiving apparatus 10 are structured so that as the toner supply hole 1*b* becomes fully connected with the toner reception hole 10*b*, it becomes impossible for the container proper 1*a* to be rotated any further. More specifically, the developing device shutter 11 attached to the container proper 1*a* is prevented by the stopper portion of the toner receiving apparatus 10, from moving further, preventing thereby the container proper 1*a* from rotating further.

During the period in which the toner reception hole 10*b* and the toner discharge hole 1*b* are being unsealed while being connected, that is, as the container proper 1*a* is rotated, the cam follower 1*g* is pushed by the wall of the camming hole 7*a* of the coupling supporting portion 7 in the direction to be moved along the camming hole 7*a*. However, the coupling supporting portion 7 is prevented, by the pair of rotation control projections 7*b* having come into contact with the toner receiving apparatus 7, from moving in the rotational direction of the coupling supporting member 7. Therefore, the force applied to the cam follower 1*g* by the coupling supporting member 7 is converted by the camming mechanism into a force which acts in the direction parallel to the axial direction of the container proper 1*a*.

Therefore, the coupling supporting member 7 is slid in the direction indicated by an arrow mark C in FIG. 8(*c*), causing the coupling 5 to be moved toward the driving force transmitting member 12 of the toner receiving apparatus 10. As a result, the coupling 5 couples with the driving force transmitting member 12, making it possible for the toner supply container 1 to receive the driving force from the main assembly (FIG. 8(*c*), FIG. 9(*c*)). As the coupling supporting portion 7 is slid in the arrow C direction (as coupling 5 couples driving force transmitting member 12), the toner supply container 1 increases in apparent length.

Through the above-described steps, it becomes possible for the driving force from the toner receiving apparatus 10 to be transmitted to the stirring member 4 through the coupling 5 and intermediary member 6, making it possible to supply the main assembly with toner.

After the completion of the toner supplying operation, the user is to rotate the toner supply container 1 in the direction opposite to the direction indicated by the arrow mark B in FIG. 8, by grasping the handle 2. As the toner supply container 1 is rotated in the opposite direction, not only is the developing device shutter 11 pulled up by the pair of projections 1*f* of the toner supply container 1, sealing the toner reception hole 10*b*, but also, the toner discharge hole 1*b* is sealed by the toner supply container shutter 3, the rotational movement of which is regulated by the toner receiving apparatus 10 (FIG. 9(*b*)-8(*b*)).

Figure 9:
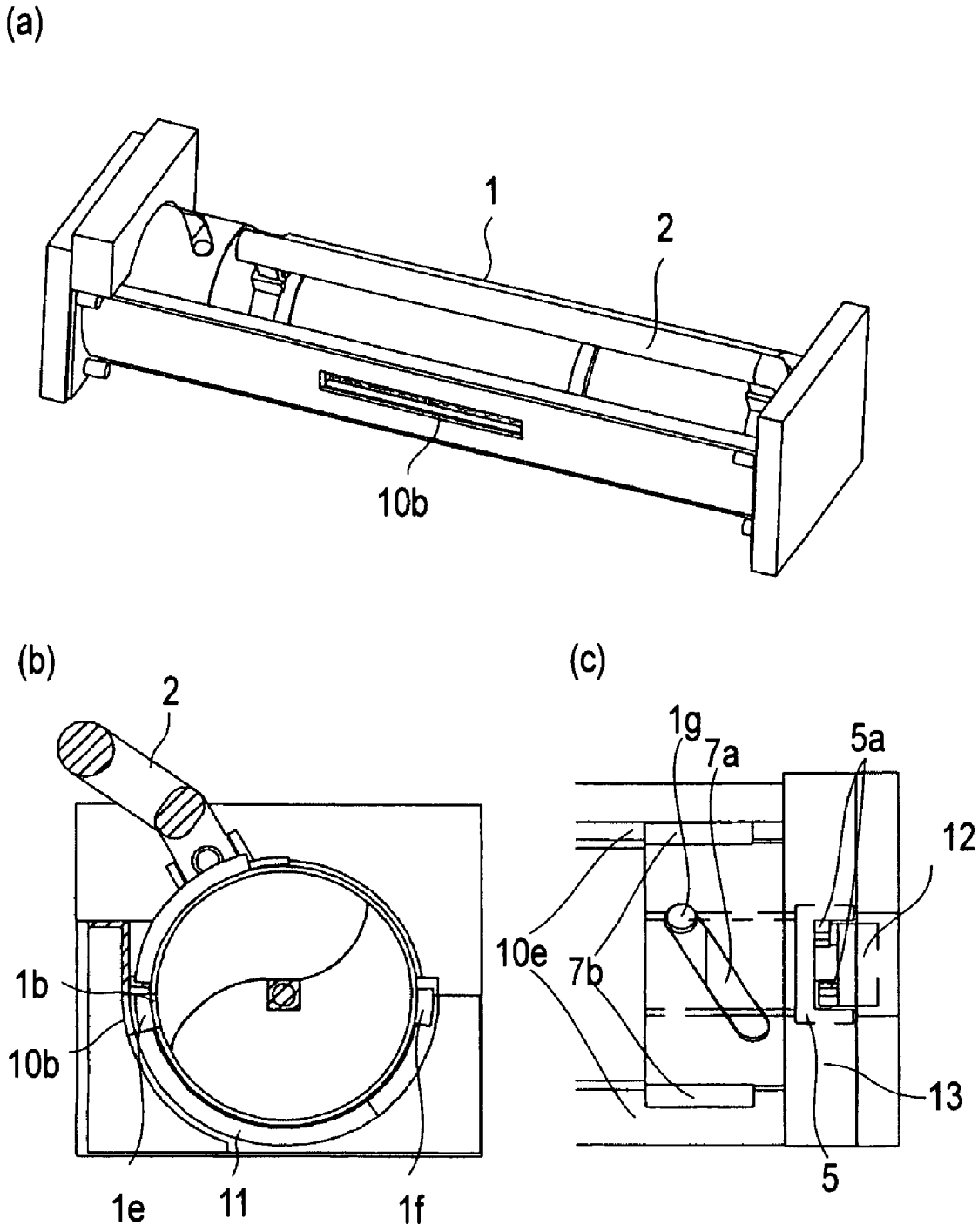
FIGS. 9(*a*), 9(*b*), and 9(*c*) are a perspective view, a sectional view (perpendicular to the axial line of the developer supply container), and an enlarged top view, respectively, of the toner supply container and toner receiving apparatus, after the rotation of the handle following the mounting of the toner supply container into the toner receiving apparatus.

Further, during the operational period in which the toner reception hole 10*b* and the toner discharge hole 1*b* are resealed, the coupling supporting portion 7 is slid in the direction opposite to the arrow B direction, causing the coupling 5 to uncouple from the driving force transmitting member 12 (FIGS. 9(*c*) 8(*c*), as the container proper 1*a* is rotated in reverse.

Then, the container proper 1*a* is to be rotated into the position, from which the toner supply container 1 can be dismounted, or into which the toner supply container 1 is mounted; in other words, the container proper 1*a* is restored to the state in which it was immediately after it was mounted into the toner receiving apparatus 10. Lastly, the user is to pull the toner supply container 1 from the toner receiving apparatus 10 to end the toner-supplying sequence.

With the provision of the above-described mechanical arrangement, that is, by structuring the toner supply container 1 and the toner receiving apparatus 10 so that as the container proper 1*a* is rotated, not only is the toner discharge hole 1*b* aligned with the toner reception hole 10*b* while being unsealed along with the toner reception hole 10*b*, by the rotation of the container proper 1*b*, but also, the coupling 5 is moved into the location at which it couples with the driving force transmitting member 12, it is possible to improve an image forming apparatus in terms of operational efficiency, without making the apparatus structurally complicated.

In other words, two separate operations can be accomplished by a single action of a user, making it possible to eliminate the time and labor necessary for the user to individually carry out two separate operations. Therefore, the apparatus can improved in operational efficiency.

Further, in the case of the structural arrangement in accordance with the prior art, during the period in which the toner discharge hole 1*b* is aligned with the toner reception hole 10*b* by the rotation of the container proper, the driving force transmitting member 12 is rotated in the direction opposite to the normal rotational direction. This problem can be prevented by this embodiment of the present invention. In other words, it is possible to prevent such problems that toner is unsatisfactorily conveyed, that the toner bearing member is unsatisfactorily coated with toner, and also, that toner leaks because the toner leak prevention sheet placed between the toner bearing member and the housing of the developing apparatus to seal the gap between them is bent and tucked into its under side.

On the other hand, by providing a locking mechanism for preventing the driving force transmitting member 12 from being rotated by the rotation of the container proper unless the toner supply container has been unsealed, it is possible to prevent the problematic phenomenon that occurs in a toner supply container structured in accordance with the prior art, that is, the phenomenon that because the stirring member in an unsealed toner supply container is rotated, coarse toner particles are formed in the toner supply container.

Further, in this embodiment, before the toner supply container is mounted into the toner receiving apparatus, the coupling 5 remains retracted in the toner supply container, that is, it is not projecting from the toner supply container. Therefore, even if the toner supply container is accidentally dropped during the shipment, or while being handled by an operator, the coupling 5 is not damaged.

Embodiment 2

Next, the toner supply container 1 as a developer supply container in the second embodiment of the present invention will be described.

The container in this embodiment is very similar in basic structure to the container in the above described first embodiment. Therefore, it will not be described here in order to avoid the repetition of the same description, and only its structural features different from those in the first embodiment will be described. The components, members, etc., of this container, which are identical in function as those of the container in the first embodiment will be given the same reference symbols as those given in the first embodiment.

Figure 10:
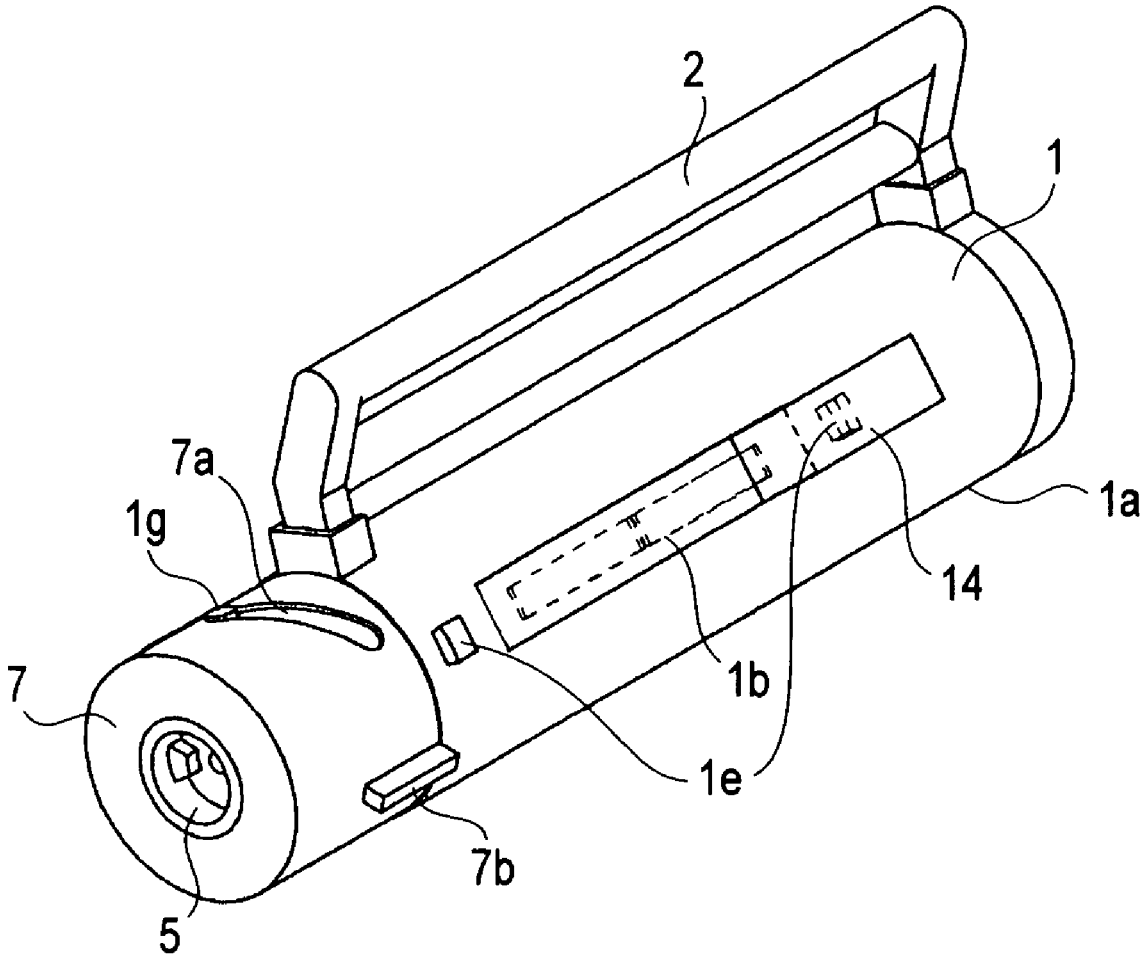
FIG. 10 is a perspective view of the toner supply container in the second embodiment of the present invention.

Referring to FIG. 10, the toner supply container 1 in this embodiment is not provided with a container shutter, such as the one in the first embodiment. Instead, its toner discharge hole 1*b* is sealed with a seal 14 formed of resin film.

In this embodiment, the seal 14 is to be peeled by an operator after the toner supply container 1 is mounted into the toner receiving apparatus 10, with the toner discharge hole 1*b* facing upward.

Thereafter, the container proper 1*a* of the toner supply container 1 is to be rotationally moved by grasping the handle 2, as was in the first embodiment, so that the developing device shutter is pushed down in the curvature direction of the container proper 1*a* of the toner supply container 1 to unseal the toner reception hole 10*b*. The procedure for resealing the toner reception hole 10*b* is the same as the one in the first embodiment, and therefore, will not be described here.

The same effects as those accomplished by the first embodiment can also be accomplished by this embodiment. However, in consideration of the contamination, or the like, which occurs after the completion of the toner supplying procedure, the first embodiment is preferable, because in the first embodiment, the toner discharge hole 1*b* is resealed by the container shutter 3.

Not only is the present invention applicable to a developer supply container structured so that it can be removably mountable in an image forming apparatus (developer receiving apparatus) to supply the main assembly of the image forming apparatus with developer, but also, it is applicable to another type of developer supply container, for example, a developer supply container structured so that it can be removably mountable in a process cartridge (which is removably mountable in main assembly of image forming apparatus, and is equivalent to developer receiving apparatus) in the main assembly of an image forming apparatus to supply the process cartridge with developer.

Here, a process cartridge is a cartridge in which the electrophotographic photosensitive member 104 as an image bearing member, and at least one image forming device among the charging device 203, the developing apparatus 201, and the cleaner 202, which act on the photosensitive member 104, which were mentioned in the above description of the preferred embodiments of the present invention, are integrally placed.

Further, instead of the combination of the coupling and driving member, as a driving force transmitting means, in the above-described first and second embodiments, a driving force transmitting means made up of a combination of gears may be employed. More specifically, in the case that a combination of gears is employed, gears will be employed as the actual driving force transmitting portion of the driving mechanism on the developer receiving side, and the actual driving force receiving portion on the developer supply container side. Also in such a case, the teeth of the gears are desired to be tapered so that the gear on the driving force transmitting side and the gear on the driving force receiving side will smoothly mesh with each other.

While the invention has been described with reference to the structures disclosed in the first and second embodiments of the present invention, it is not confined to the details set forth, and this application is intended to cover such modifications or changes as may come within the purposes of the improvements or the scope of the following claims.

This application claims priority from Japanese Patent Applications Nos. 411339/2003 and 341604/2004 filed Dec. 10, 2003 and Nov. 26, 2004, which is hereby incorporated by reference.

What is claimed is:

1. A developer supply container detachably settable to a developer receiving apparatus by a setting operation including at least a rotation thereof, said container comprising:

a container body configured to contain a developer, said container body having a developer discharge opening configured and positioned to discharge the developer toward a developer receiving opening provided in the developer receiving apparatus;

a rotatable feeding member configured and positioned to feed the developer in said container body toward said developer discharge opening;

a drive coupling member configured and positioned to operatively couple with a driving member provided in the developer receiving apparatus to receive a rotational force for rotating said feeding member, said drive coupling member being movable relative to said container body to a position for operative coupling with the driving member in a rotational axis direction thereof; and an interrelating mechanism configured and positioned to interrelate an operation of movement of said drive coupling member to the position with an operation of rotational movement of said developer discharge opening to face the developer receiving opening by the setting operation.

2. A developer supply container according to claim 1, further comprising a grip portion configured and positioned to rotate said container body for the setting operation, wherein said interrelating mechanism moves said drive coupling member to the position, utilizing the rotation of said container body.

3. A developer supply container according to claim 1, wherein said interrelating mechanism interrelates an operation of movement of said drive coupling member to a position where said drive coupling member is retracted from the driving member in the direction with an operation of rotational movement of said developer discharge opening to a position for permitting a removal of said developer supply container from the developer receiving apparatus.

4. A developer supply container according to claim 3, wherein said interrelating mechanism includes a cam mechanism configured and positioned to advance and retract said drive coupling member in the direction.

5. A developer supply container according to claim 1, wherein a mounting and demounting direction of said developer supply container relative to the developer receiving apparatus crosses the direction of the movement of said drive coupling member.

6. A developer supply container according to claim 1, said feeding member is rotatable relative to said container body which substantially non-rotatably is set to the developer receiving apparatus when said developer discharge opening faces the developer receiving opening.

7. A developer supply container according to claim 1, further comprising a container shutter configured and positioned to open and close said developer discharge opening, wherein said interrelating mechanism interrelates an opening operation of said container shutter with the operation of the rotational movement of said developer discharge opening, and interrelates a closing operation of said container shutter with an operation of a rotational movement of said developer discharge opening to a position for permitting a removal of said developer supply container from the developer receiving apparatus.

8. A developer supply container according to claim 1, wherein said drive coupling member is retractable inwardly of an outer surface of said developer supply container.

9. A developer supply container according to claim 1, further comprising an engaging portion, engageable with an apparatus shutter of the developer receiving apparatus that opens and closes the developer receiving opening, to open and close the apparatus shutter with a rotation of said container body which is mounted to the developer receiving apparatus.

10. A developer supply container detachably mountable to a developer receiving apparatus including a developer receiving opening and an apparatus shutter for opening and closing the developer receiving opening, said container comprising:

a container body configured to contain a developer, said container body having a developer discharge opening configured and positioned to discharge the developer toward the developer receiving opening provided in the developer receiving apparatus;

a rotatable feeding member configured and positioned to feed the developer in said container body toward said developer discharge opening;

a drive coupling member configured and positioned to operatively couple with a driving member provided in the developer receiving apparatus to receive a driving force, said drive coupling member being movable relative to said container body to a position for operative coupling with the drive member in a rotational axis direction thereof;

an engaging portion engageable with the apparatus shutter to open the apparatus shutter by rotation thereof; and an interrelating mechanism configured and positioned to interrelate an operation of movement of said drive coupling member to the position with an opening operation of the apparatus shutter by said engaging portion.

11. A developer supply container according to claim 10, further comprising another engaging portion engageable with the apparatus shutter to close the apparatus shutter by rotation thereof, wherein said interrelating mechanism interrelates an operation of movement of said drive coupling member from the position to a position where said drive coupling member is retracted from the driving member with a closing operation of the apparatus shutter by said another engaging portion.

12. A developer supply container according to claim 11, wherein said interrelating mechanism includes a cam mechanism for advancing and retracting said drive coupling member to and from the driving member respectively.

13. A developer supply container according to claim 12, wherein a mounting and demounting direction of said developer supply container relative to the developer receiving apparatus crosses the rotational axis direction.

14. A developer supply container according to claim 11, said engaging portion and said another engaging portion are formed on a peripheral surface of said container body.

15. A developer supply container according to claim 14, further comprising a grip portion configured and positioned to rotate said container body, wherein said interrelating mechanism moves said drive coupling member between the position where said drive coupling member is coupled with the driving member and a position where said drive coupling member is retracted from the driving member, utilizing the rotation of said container body.

16. A developer supply container according to claim 10, wherein said feeding member is rotatable relative to said container body which substantially non-rotatably is set to the developer receiving apparatus when said developer discharge opening faces the developer receiving opening.

17. A developer supply container according to claim 10, further comprising a container shutter configured and positioned to open and close said developer discharge opening, wherein said container shutter is opened and closed with the opening and closing operations of the apparatus shutter respectively.

18. A developer supply container according to claim 10, wherein said drive coupling member is retractable inwardly of an outer surface of said developer supply container.

19. A developer supply container according to claim 10, said engaging portion is formed on a peripheral surface of said container body.

20. A developer supply container according to claim 19, further comprising a grip portion configured and positioned to rotate said container body, wherein said interrelating mechanism moves said drive coupling member to the position, utilizing the rotation of said container body.

* * * * *

UNITED STATES PATENT AND TRADEMARK OFFICE

CERTIFICATE OF CORRECTION

PATENT NO. : 7,242,893 B2
APPLICATION NO. : 11/004975
DATED : July 10, 2007
INVENTOR(S) : Katsuya Murakami et al.

It is certified that error appears in the above-identified patent and that said Letters Patent is hereby corrected as shown below:

ON THE COVER PAGE

Item (73), Assignee, "Canon Kabiushiki Kaisha" should read --Canon Kabushiki Kaisha--.

At Item (56), Foreign Patent Documents, "JP 3095050 8/2000" should read --JP 3095050 1/2000--.

COLUMN 2

Line 13, "breaks" should read --break--.

COLUMN 4

Line 54, "Flapper 1118," should read --Flapper 118,--.
Line 55, "roller" should read --rollers--.

COLUMN 10

Line 35, "can improved" should read --can be improved--.

COLUMN 12

Line 65, "said" should read --wherein said--.

COLUMN 14

Line 43, "said" should read --wherein said--.

Signed and Sealed this

Third Day of February, 2009

John Doll

JOHN DOLL
*Acting Director of the United States Patent and Trademark Office*